United States Patent [19]

Conti

[11] 4,416,447

[45] Nov. 22, 1983

[54] MACHINE FOR FORMING BOOKLETS OF INTERCALATED SHEETS

[76] Inventor: Romano Conti, Via Pier della Francesca 37, Prato, Firenze, Italy

[21] Appl. No.: 299,179

[22] Filed: Sep. 3, 1981

[30] Foreign Application Priority Data

May 14, 1981 [IT] Italy ..... 9413 A/81
May 14, 1981 [IT] Italy ..... 11646/81[U]

[51] Int. Cl.[3] ..... B65H 39/02
[52] U.S. Cl. ..... 270/54; 270/58
[58] Field of Search ..... 270/54–56, 270/58; 271/269, 271

[56] References Cited

U.S. PATENT DOCUMENTS 813,908 2/1906 Miller ..... 270/58
2,144,821 1/1939 Twomley ..... 270/58 X
3,054,612 9/1962 Godlewski .
3,126,199 3/1964 Rosoff ..... 271/12

FOREIGN PATENT DOCUMENTS 1156418 6/1969 United Kingdom ..... 270/58

*Primary Examiner*—A. J. Heinz
*Attorney, Agent, or Firm*—McGlew and Tuttle

[57] ABSTRACT

In a seat for a pile of booklet components of considerable thickness a conveyor is provided which is able to withdraw the lower component of the pile and bring it into a holding position. The conveyor is driven in synchronism with the transfer of the element from the hold position to a main conveyor which, successively, receives the booklet components. This main conveyor may be driven with reciprocating movements of commutable amplitudes.

6 Claims, 15 Drawing Figures f3
12
15
14
14A
16
22
20
42
18
24
26
28
30
36
32
38
38
44
44A
56
54
50
52
48
46
β
V
V
V
1

MACHINE FOR FORMING BOOKLETS OF INTERCALATED SHEETS

FIELD AND BACKGROUND OF THE INVENTION

The invention relates to a machine having a main conveyor of sheets, for the formation of booklets with intercalated multiple sheets, which presents seats for piles of sheets and sucker means—or equivalent—for transferring single sheets from the relevant pack to a plane where booklets are to be formed, which is slightly inclined and which is part of the main conveyor, the conveyor being able to provide intermittent advancements.

SUMMARY OF THE INVENTION

It is an object of the present invention to permit the feeding of relatively thick elements, which form piles that are too high to allow the pick up from the top of the pile by means of suckers, so that there would be necessary a continuous intervention from the operator to supply piles having relatively limited height—and thus quickly exhaustible—of such thick elements, like folded sheets or the so-called "signatures."

A further object of the invention is to improve said main conveyor which includes an equipment alternatively movable either in longitudinal or vertical direction, with pegs apt to project above a plane of sheets formation to perform the active stroke by acting on the sheets back edge, and to move below the plane to perform the backward stroke. The longitudinal stroke of the equipment is obtained through a linkage including a crank, a driving lever and a connecting rod, the linkage being modifiable to obtain at least two active strokes one greater than the other.

These and other objects of the invention will be apparent from the following description relating to a preferred embodiment.

DESCRIPTION OF THE PREFERRED EMBODIMENTS

Figure 4:
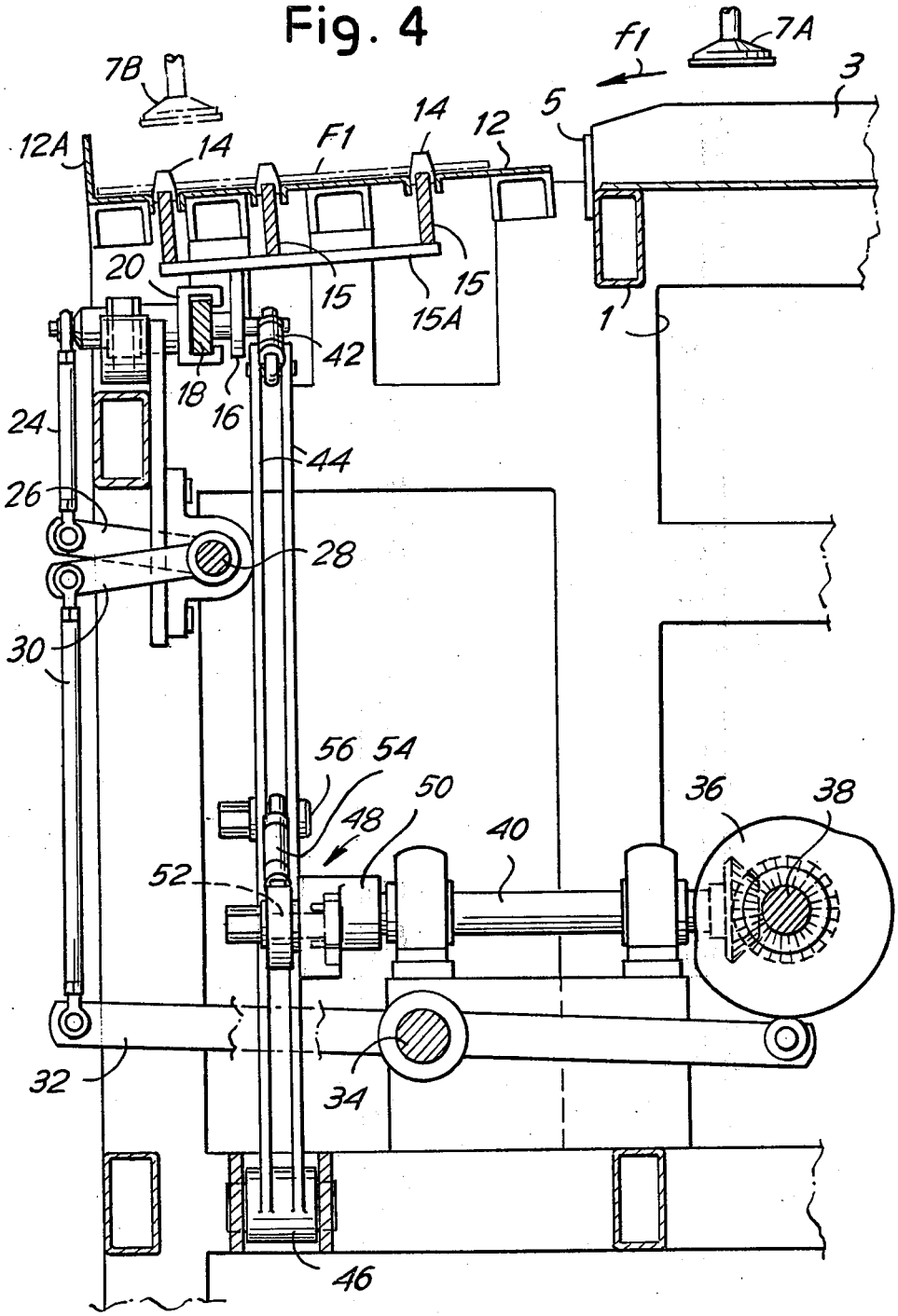
FIG. 4 is an enlarged cross section taken on line IV—IV of FIG. 1.
Figure 5:
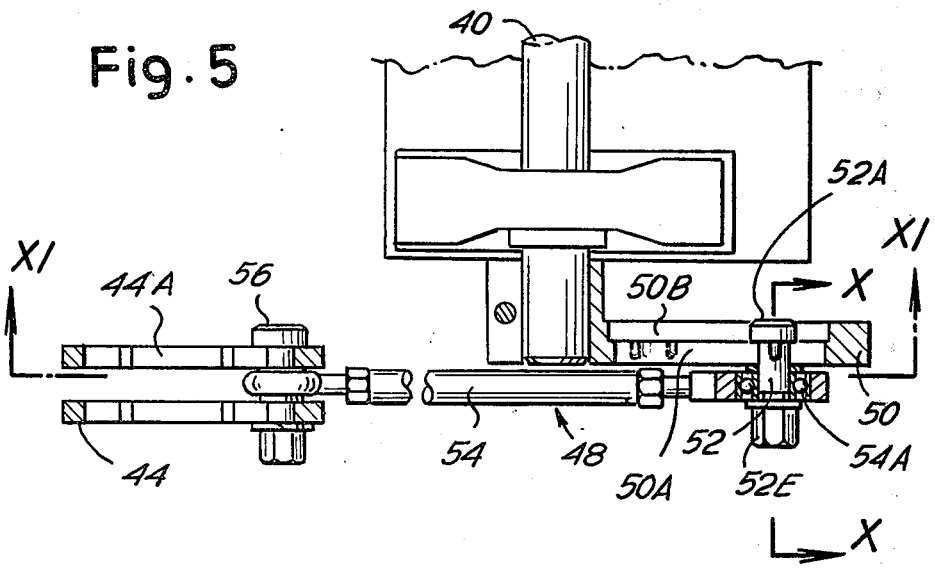
FIG. 5 is an enlarged local section taken on line V—V of FIG. 3.
Figure 6:
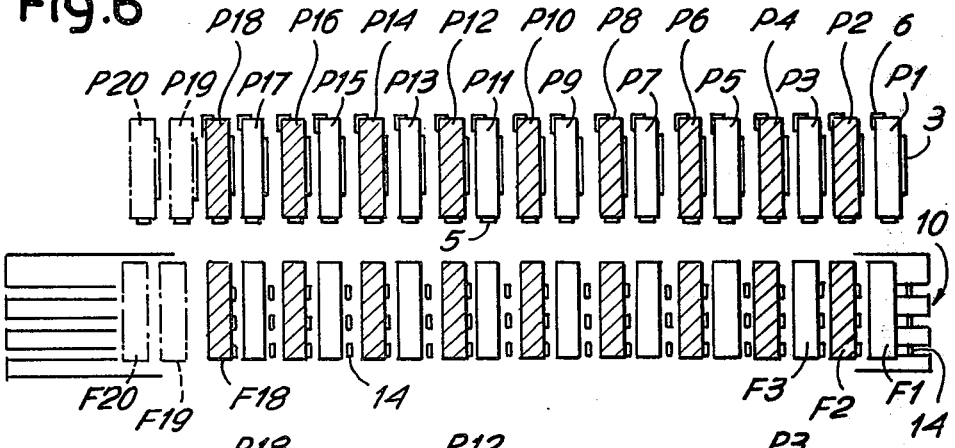
FIGS. 6 and 7, show plan views of the two illustrative arrangements of the various printed forms and sheets position in the working conditions of FIGS. 1 and 2.
Figure 7:
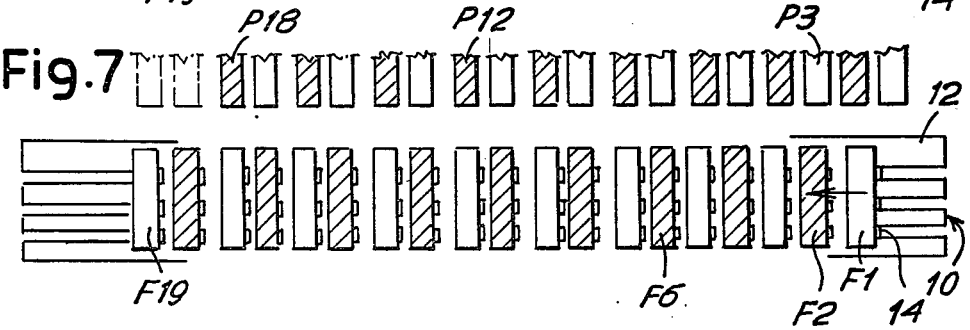

In a framework 1 seats are formed for packs of sheets to be intercalated and, in particular, twenty seats are provided, according to the example in the drawings, for packs of sheets having small format indicated by $P_1$, $P_2$ . . . $P_{20}$ (FIGS. 6, 7). Each seat is defined—for a right positioning of the packs—by a lateral bank 3 and head ledges 5, as well as by an adjustable square 6. The equipment is provided, as usual, in correspondence of each seat and thus in correspondence of each pack positioned on the machine, with transfer means in the form of holding suckers 7, which from the position indicated by 7A in FIG. 4 reach a position indicated by 7B, for transferring the single sheets from the pack according to arrow f1 of FIG. 4 towards a position where said sheets are indicated by $F_1$, $F_2$, $F_3$ . . . $F_{19}$ and eventually $F_{20}$. The transferring sucker means in the position 7B place the sheets indicated by $F_1$, $F_2$, $F_3$ . . . $F_{19}$ and eventually $F_{20}$ onto a steps conveyor which is generally indicated by 10 and which will be described in detail hereinafter. The conveyor is arranged, with reference to FIGS. 1, 2, 4, 5, 6 and 7, to perform an advancing step as illustrated by comparison between FIGS. 6 and 7, that is a step which is suitable for the size of the seats for the packs $P_1$ to $P_{20}$ of more reduced format. The conveyor is also arranged for handling sheets of larger format, as will be better indicated later.

The conveyor generally denoted with 10 comprises a plane 12 downwardly inclined starting from the longitudinal edge closest to the front of the seats for packs $P_1$ to $P_{20}$. This plane is provided with three longitudinal slots from which transferring pegs 14 can protrude susceptible of performing a transfer stroke of the sheets which are located in the position like the one indicated by $F_1$ in FIG. 4, therein transferred starting from the respective packs by the sucker means 7A, 7B. A bank 12A defines a ledge for the sheets edge which is previous with respect to the transfer movement according to arrow f1 by the transfer sucker means 7A, 7B. The pegs 14 are releasably mounted on bars 15 connected by crosspieces 15A to make up a movable equipment linked through supports 16 to a sliding bar 18. This bar is slidably received in supports 20 movable in a substantially vertical direction and in particular carried by the mobile ends of small connecting rods 22 oscillating about fixed articulated joints 22A of the framework 1. The supports 20 are moved to a substantially vertical direction by oscillation of the small connecting rods 22 through stems 24 which are articulated to arms 26 distributed along a shaft 28. This shaft is angularly movable with reciprocating motion by control of a linkage 30 and driven by a rocker lever 32 (see in particular FIG. 4) having its fulcrum in the central part 34 and driven by a cam with follower 36 on a shaft 38 supplied with continous motion. With this arrangement—the rocker lever 32 being driven in an oscillating way—it is possible to determine the lifting and lowering of the slide seats for the horizontal bar 18 and hence it is possible to control the cyclic lifting and lowering of the bars 15 and crosspieces 15A and therefore the cyclic lifting and lowering of the pegs 14 from a protruding position to a receded position with respect to the inclined plane 12, which takes place with synchronism to the longitudinal movement that can be performed by said equipment owing to the sliding of bar 18 with respect to the seats made up by supports 20.

The bar 18 and hence the equipment 15, 15A, 14 are driven with reciprocating longitudinal slide by a shaft 40 which takes the movement from the shaft 38 with perfect synchronism with respect to the latter, by means of a transmission which includes an articulated rod 42, an oscillating bar 44 articulated in the point 46 to the framework 1 and a crank-connecting rod system generally indicated by 48 between the oscillating lever 44 and the shaft 40. In particular, the crank-connecting rod system comprises a crank 50 whose crank-pin 52 articulates a connecting rod 54 engaged in turn to the lever 44 by means of an articulation pivot 56. The pivot 52 is susceptible to reach two positions at the ends of a slot 50A of the crank 50, thus modifying the eccentricity of the crank-pin 52. In turn, also the articulation pivot 56 between the connecting rod 54 and the lever 44 may be made to slide along the slots 44A formed in the double thickness which is offered by the lever 44 in correspondence of the articulation zone of the connecting rod 54 (FIG. 5).

Figure 11:
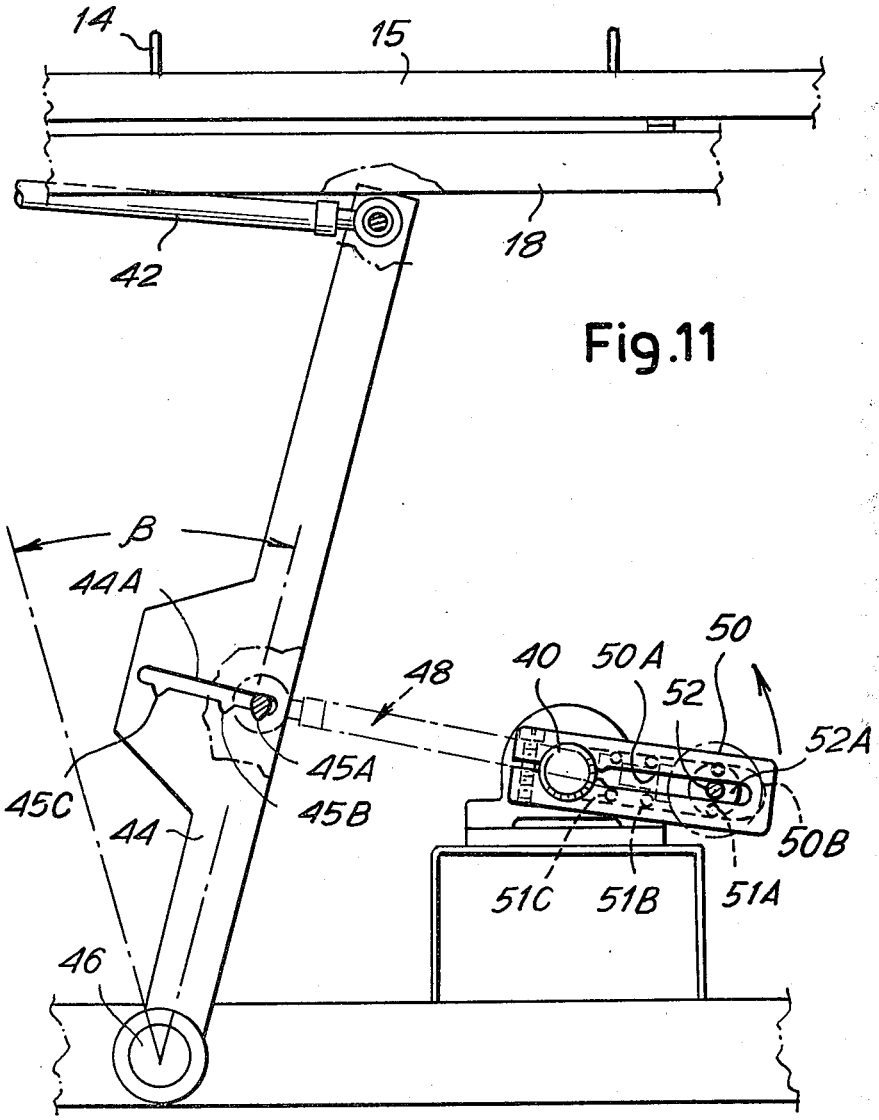

The lever 44 may present, in addition to the two end positions for the engagement of the articulation pivot 56, at least an intermediate seat for an intermediate format of sheets with respect to the two minimum and maximum formats for which the two end positions can be utilized. The same thing occurs in crank 50 for the articulation 52 of the connecting rod 48. For this purpose, in practice, the pivot 52 is supplied on the head 52A with pins 52B, the pivot 52 receiving the bearing 54A of the connecting rod 48, which bearing is tightened with the nut 52E. The head 52A slides within the depression 50B extending therefrom along with the slot 50A of the crank 50 and able to partially receive the head 52A. The pins 52B (or other equivalent reference) are susceptible to be housed in the seats 51 arising from the depression 50B and flanking the slot 50A. These seats or holes of reference 51 are formed at a plurality of end positions 51A and 51C and also at an intermediate position 51B at least (FIG. 11). Correspondingly, in the slot 44A formed into each of the two plates of the lever 44, end reference grooves 45A, 45C are provided as well as an intermediate groove 45B at least. The pivot 56 may be positioned—by means of a reference—in correspondence of one or the other of reference grooves 44A, 44B, 44C according to the position imposed to the pivot 52.

With this arrangement it is possible to easily manipulate three formats of paper with the machine, by utilizing, of course, tanks correspondingly dimensioned and providing transfer suckers and pushers properly located and distributed. The machine can, as a limit, present more than one intermediate position in addition to the ones 51B and 45B for the articulations 52 and 56, so as to consider further paper formats in addition to those mentioned.

The arrangement of the crank-connecting rod system 48 with variable eccentricity permits changing of the angular displacement of the lever 44 and therefore also the longitudinal stroke of the equipment 14, 15, 15A of the conveyor 10. It is then possible to modify the advancement stroke of the sheets which have been laid down onto the plane 12. The corresponding variation of the engagement between the lever 44 and connecting rod 54 permits the constant maintenance of the starting point of the conveyor stroke, with the stroke still changing.

Figure 1:
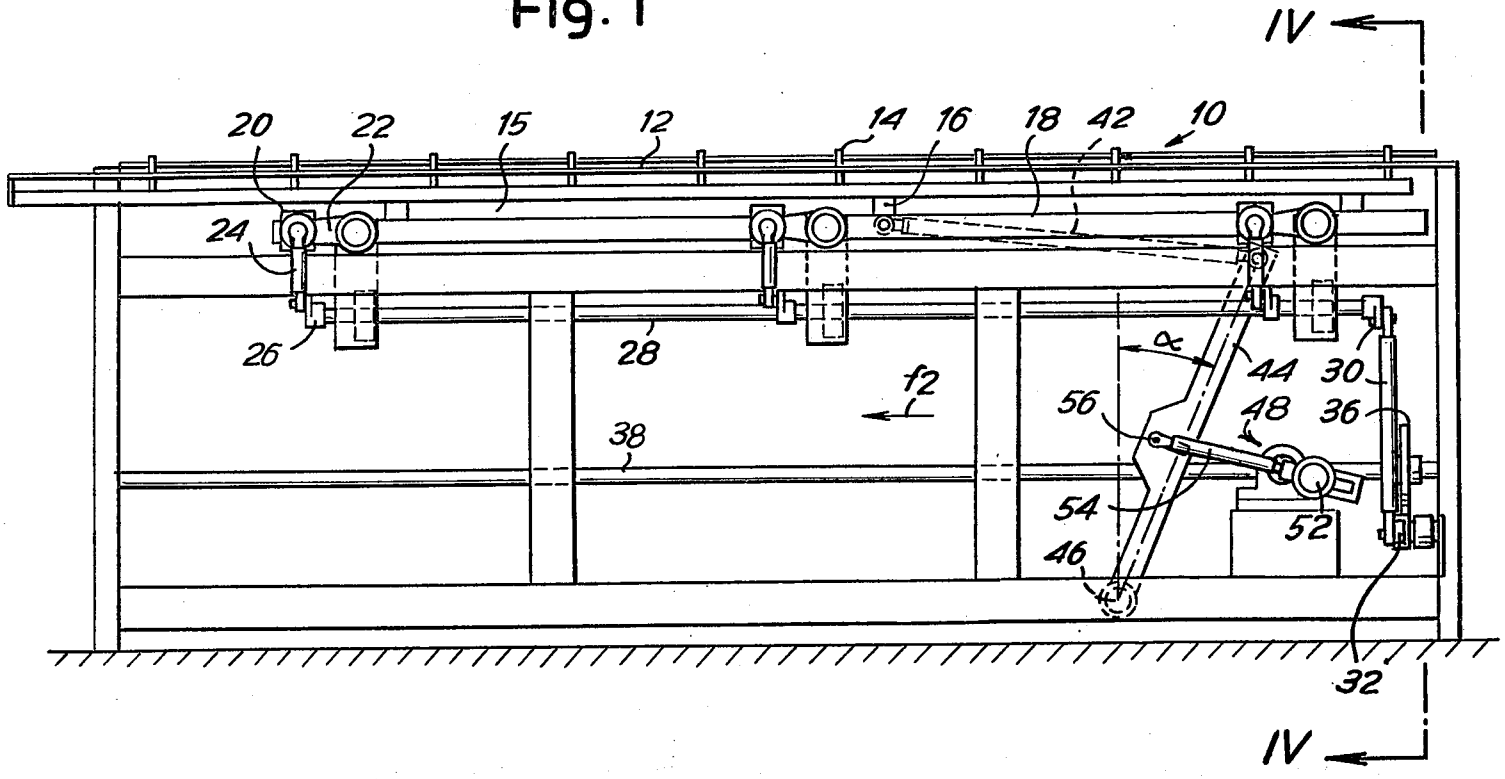
FIGS. 1 and 2 show the machine as a whole in two positions of starting and finishing advancement, in a development for the formation of booklets of minor format.
Figure 2:
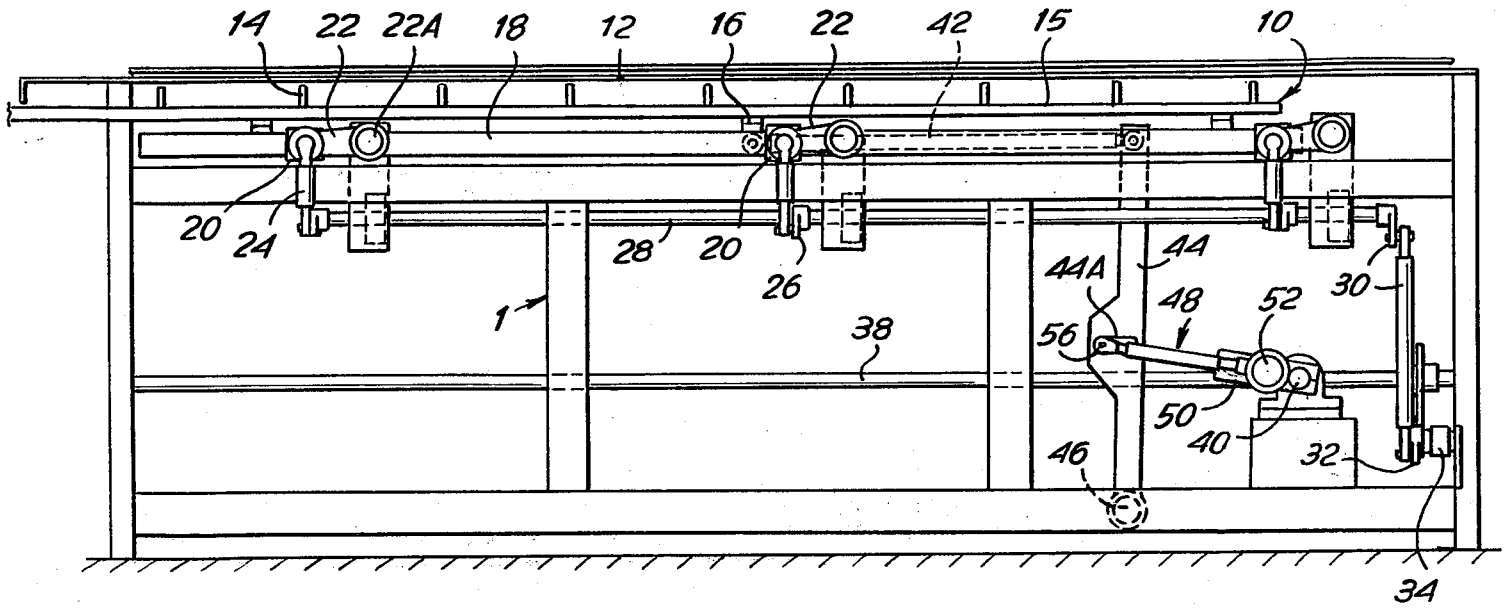
Figure 3:
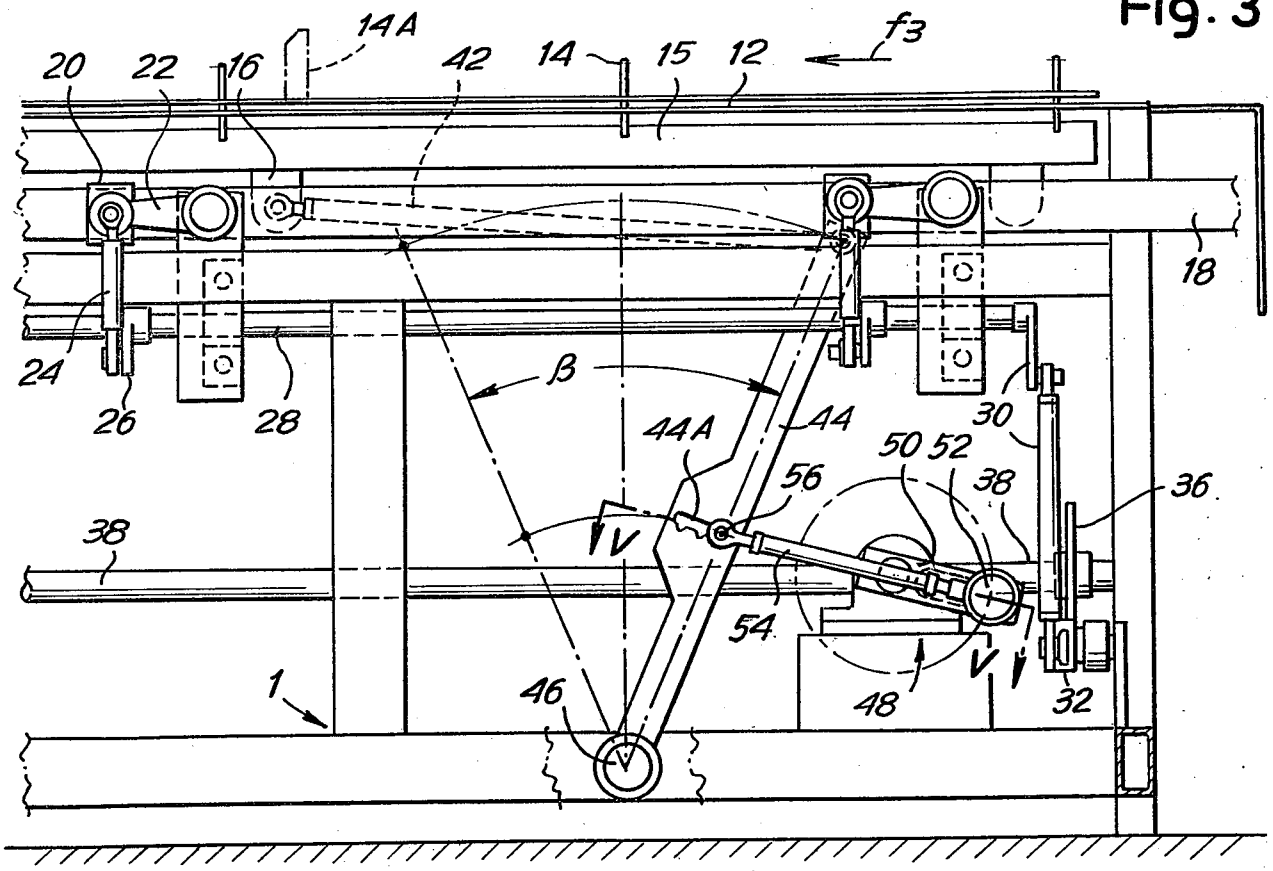
FIG. 3 shows an enlarged detail in an arrangement analogous to the one of FIG. 1, but with the disposition equipped for a greater transferring step, that is for booklets of greater size.

When the eccentricity is the least, that is with the pivot 52 positioned by the seats 51C and the pivot 56 positioned in the seat 45C, the active stroke of the conveyor is defined by the angular displacement indicated with $\alpha$ (FIGS. 1 and 2) of the lever 44, which transmits the thrust to the bar 18 through the stem 42. When the displacement of the bar 18 and hence of the equipment 14, 15, 15A is accomplished according to arrow f2, the pegs for the drive of the 36, 32, 30 system are lifted and thus they pick up the edge of the sheet, respectively of the complex of sheets which lie on the plane 12 in front of each sheets pack $P_1$ to $P_{19}$. From this it follows that during the active stroke according to arrow f2 with the pegs 14 being lifted, the transfer of the sheets by one step along the plane 12 is obtained. The starting action of the pegs 14 must take place when the sheets are still laid on the plane 12. Soon after it is possible to act in such a way that with the last lift phase of the pegs 14 also the bars 15 project from the slots of the plane 12 which lift the sheet or sheets, making their transfer easy without sliding on plane 12. Thus, an accurate levelling of the edges of the sheets on which the pegs operate is obtained at the beginning of the pegs thrust, the sheets being laid on the plane and sliding thereon with some friction. Soon after the sheets are lifted from the plane 12 by means of the bars, and the disadvantages of sliding are avoided. Once the active stroke has been accomplished according to arrow f2, the pegs are lowered as a consequence of the lowering of said equipment 14, 15, 18 and the return stroke takes place with synchronism owing to the lever 44, always for an angle $\alpha$ corresponding to the minimum eccentricity predetermined for the crank-connecting rod system 48. It must be noted that the step between the pegs 14 of the successive rows corresponds to the distance between the successive banks 3. The housing of the sheets on the conveyor is obtained through elements adjustable in position like 14A (FIG. 3), which are mounted on the bars 15 defining, with the relevant fixed elements 14, spacings little greater than the size of the sheets in the advancement direction. Consequently, the sheets are always centered and kept in the interspace between successive transversal rows of pegs 14 and 14A, whereby being ensured the regular transfer of the sheets respectively of the sheets booklets which are formed along the plane 12, even though the transfer speed is relatively high and hence, even though there is a relatively high acceleration of the sheets. The sheets pushed along by their own rows of pegs do not tend and cannot overlap on the sheets of the previous row because of the presence of the pegs 14A which hold the sheets thus preventing the partial overlap. On the other hand, even if an irregularity occurs in the positioning of the sheets, the subsequent lift of the pegs in correspondence of the interspace between a booklet and the next one in formation permits, after a few operations, to ensure once more the separation of the sheets of a booklet with respect to those of the adjacent booklet which may be partially superimposed.

Figure 6A:
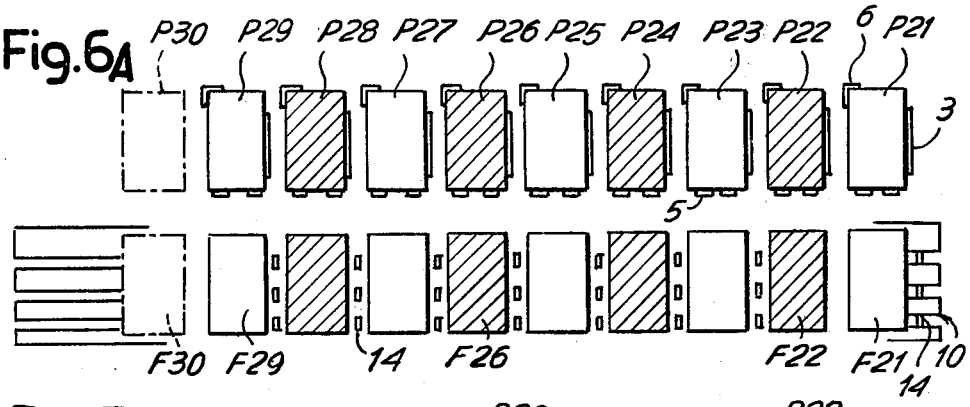
FIGS. 6A and 7A are similar to FIGS. 6 and 7 but show the positions for larger sheets.
Figure 7A:
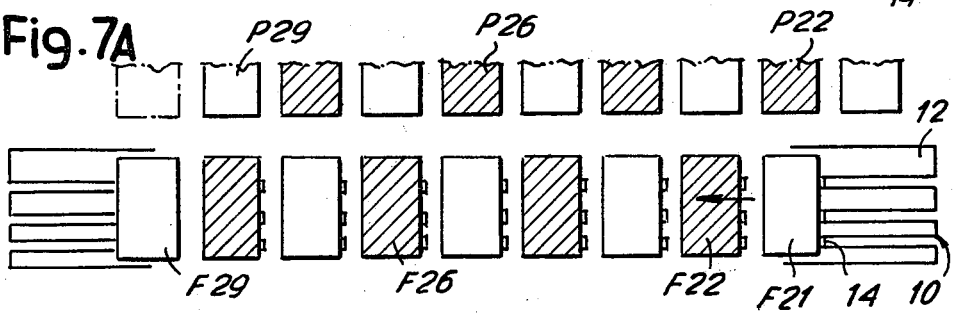
Figure 8:
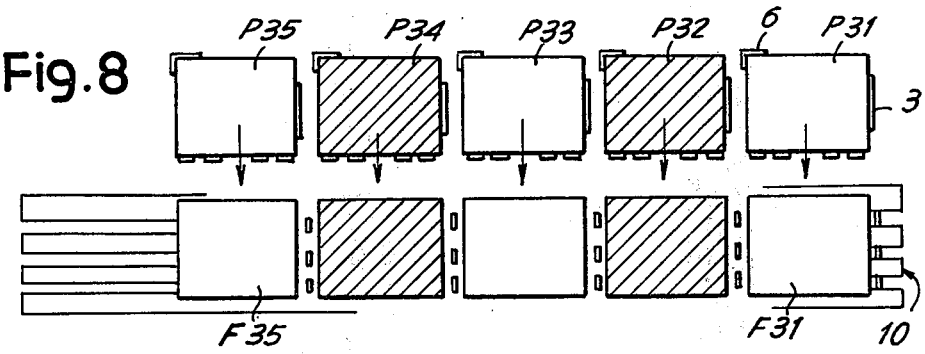
FIGS. 8 and 9 are similar to FIGS. 6A and 7A but show the positions for still larger sheets.
Figure 9:
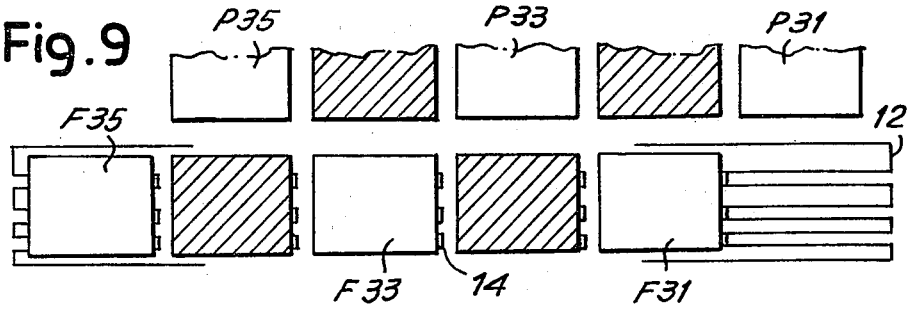
Figure 10:
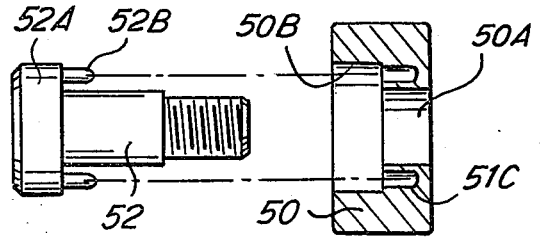
FIGS. 10 and 11 show two details in section on lines X—X and XI—XI respectively of FIG. 5.

The step accomplished by an angular run of the lever 44 corresponds to a step between successive packs $P_1$ to $P_{19}$ when the machine is equipped for a format of sheets corresponding to the one of packs $P_1$ to $P_{19}$. The machine and in particular the conveyor are further realized to permit a possibility of manipulating also sheets of greater size, even double or quadruple of that of the format allowed by the seats receiving the packs $P_1$ to $P_{19}$, by positioning the articulations 52 and 56 in the position 51B, 45B or 51A, 45A. To effect this transfomation few operations are required. In particular and first of all, it is necessary to eliminate some of the banks 3 to receive packs of sheets, for example those $P_{21}$, $P_{22}$, etc. up to $P_{30}$ of greater format as much as two times the one allowed by the seats of packs $P_1$ to $P_{20}$, and the pegs corresponding to the lacking banks 3 must be eliminated, so that the sheets indicated by $F_{21}$ to $F_{30}$ in FIGS. 6A and 7A can be received in the interspaces defined by the pegs present in the mobile equipment of advancement and which project periodically and move along the inclined plane 12. Secondly, it is necessary to eliminate additional banks 3 for receiving packs of sheets $P_{31}$ . . . $P_{35}$ of greater format as much as four times the one allowed by the seats for the packs $P_1$ to $P_{19}$ and the pegs corresponding to the lacking banks 3 must be eliminated, so that the sheets indicated by $F_{31}$ to $F_{35}$ in FIGS. 8 and 9 can be received in the interspaces defined by the pegs present in the mobile equipment of advancement.

On the other hand, it is necessary to modify the stroke of the mobile equipment of pegs 14 by simply modifying the eccentricity of the crank-connecting rod system 48, by moving the crank-pin 52 from the position of minimum eccentricity to the position of intermediate or maximum eccentricity along the slot 50A, and blocking it again in the new position reached. This operation must be combined with an operation of temporary disengagement of the articulation 56 from the position it had maintained along the slots 44A under the conditions of FIGS. 1, 2 and 6, 7, 11, so as to maintain the position of the conveyor equipment during the operation of eccentricity variation. Substantially, the pivots 52 and 56 are released from the slots 50A and 44A respectively, and the eccentricity is modified in the above mentioned manner, thus permitting a sliding of the articulation pivot 56 with respect to the lever 44 (which is kept in the reached position), and then said articulation 56 is blocked again in the new position it has assumed—after the variation of eccentricity of the crank-pin 52—along the slots 44A. At this point, to each active stroke and hence to each oscillation of the lever 44 there corresponds an angle $\beta$ (or$\gamma$) of lever 44 which is greater than the angle $\alpha$, owing to the increase of eccentricity of the crank-connecting rod system 48, and which corresponds to an advancement step of the pegs 14 equipment according to arrow f3 of FIG. 3, as it is necessary for the new increased format of the sheets and packs placed on the machine when it has been equipped for this new size, that is for this new format of the sheets to be handled.

For the format of the sheets shown in FIGS. 6 and 7 the articulations are at positions 51C and 45C. For the format of FIGS. 6A and 7A the articulations are at positions 51B and 45B. For the format of FIGS. 8 and 9 the articulations are at positions 51A and 45A.

Substantially, the transformation of the conveyor and hence of the whole machine for working with different formats is obtained very easily, by permitting three types of advancement and hence three formats between a maximum and a minimum differentiated the one from the other. Further, the possibility to modify the equipment of the machine in order to obtain an intermediate advancement step for other particular workings is not excluded. According to the illustrated example, it is possible to equip the machine for reduced formats (by which it is possible to achieve booklets up to nineteen or twenty sheets), respectively for greater formats to get booklets of five sheets at the most.

Further possibilities concerning the dimensions of the stroke and hence of the formats may be obtained with adequate possibilities of positioning and dimensioning the seats for the packs and of positioning the pegs.

A machine of the type described above has been improved to make up booklets with intercalated multiple sheets, wherein at least one of the booklet components may be an element of considerable thickness or made up of a plurality of thicknesses, for example of a folded sheet, like the so-called "signatures" of various format. In these cases the layout of a tank or seat like the ones defined by the banks 3 and ledges 5 for a drawing by means of suckers 7, has proved difficult to attain. In fact, firstly, the suckers cannot perform considerable excursions in the vertical direction nor can they get over determinate gradients between the hold positions 7A and the release positions 7B. Secondly, the elevated thickness of each component (like thin cardboard, thick card, signature or other) determines the formation of piles considerably high even with a relatively very limited number of pieces, which would impose—with the traditional solution of direct drawing by means of the suckers—a too frequent feed of material into the seat to keep the pile height limited, and thus a considerable care by the operator.

The equipment according to the invention avoids these difficulties in a machine of the above mentioned kind—or equivalent—when the equipment in object is placed in correspondence of the or of each feed position of a component having considerable thickness.

Figure 12:
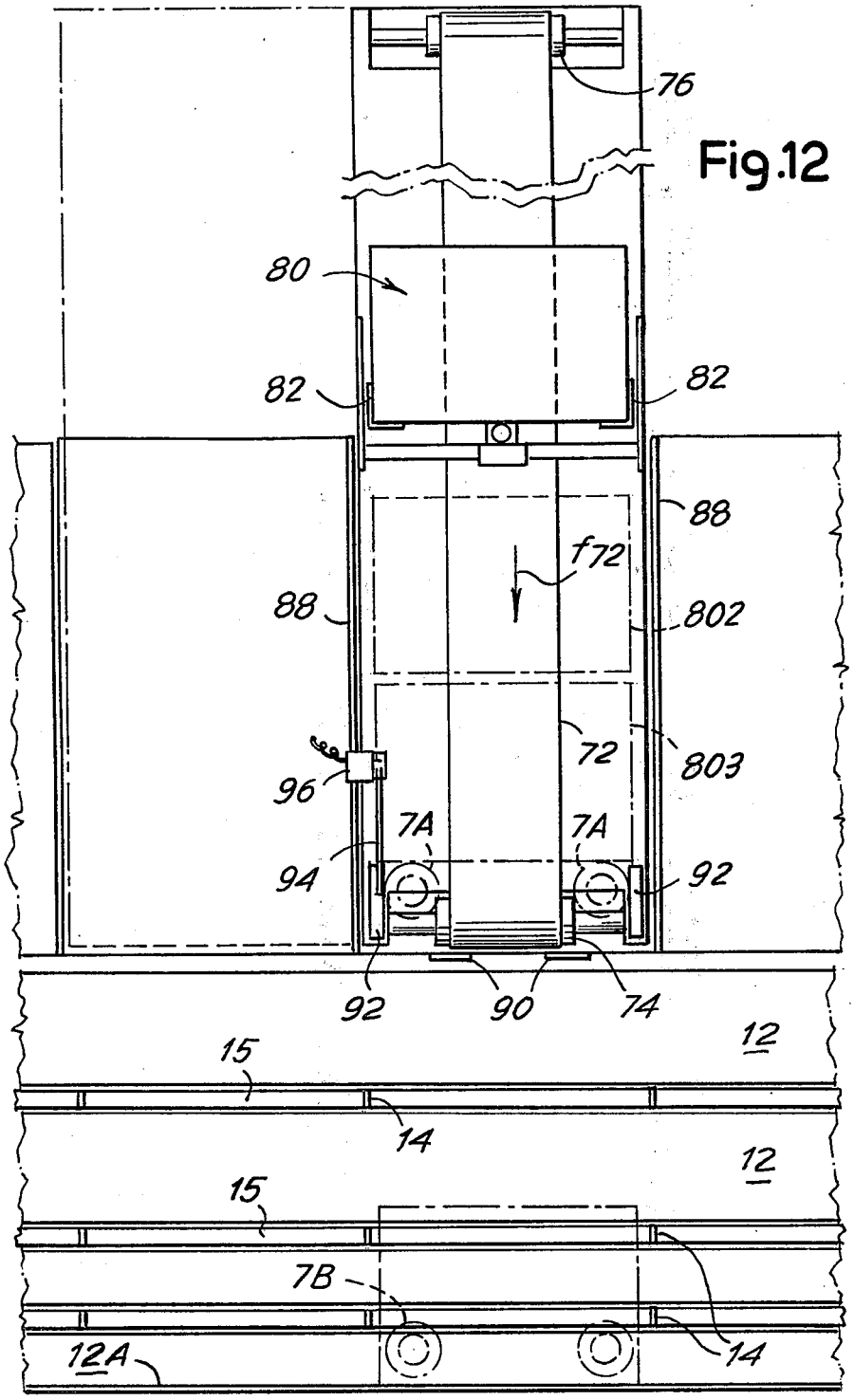
FIGS. 12 and 13 show a detailed construction of the invention in respective top plan and side elevational views.
Figure 13:
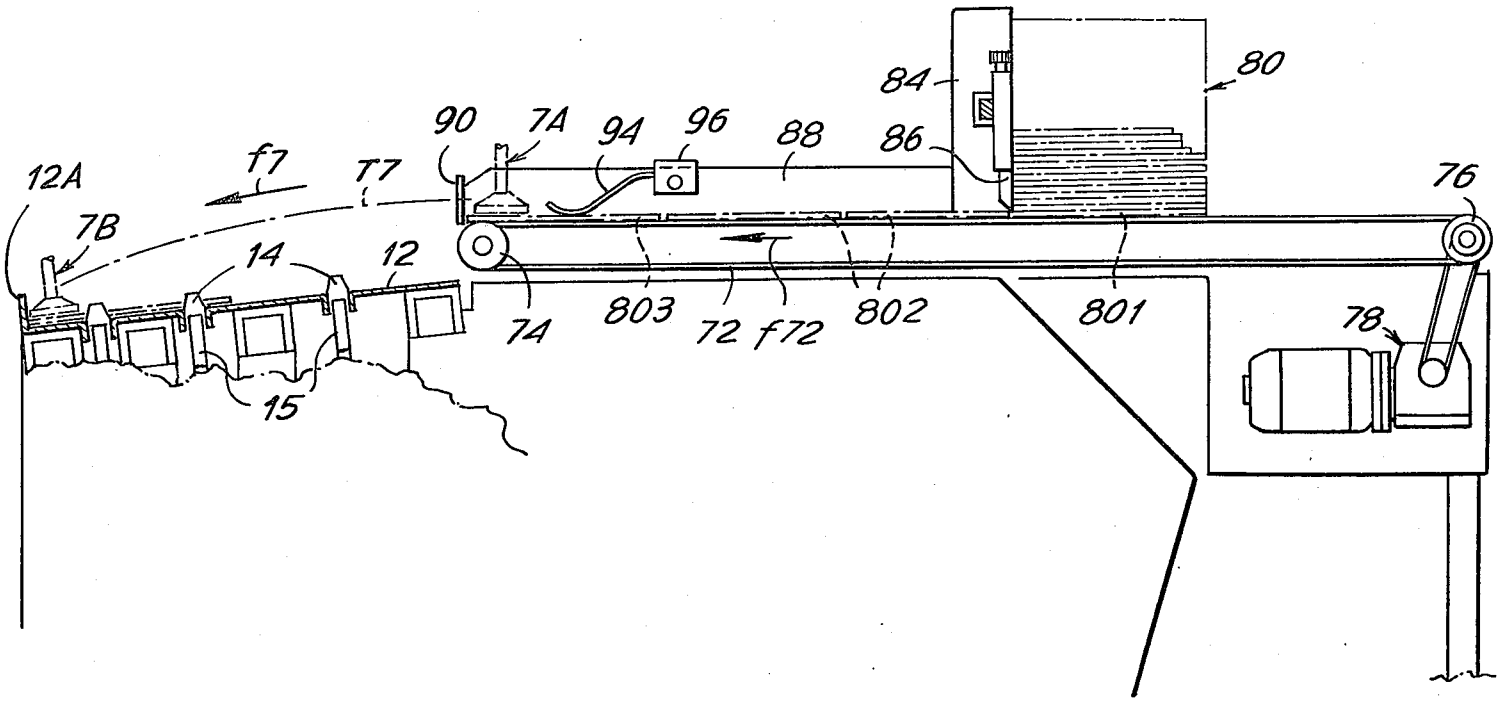

As it can be seen in the example shown in FIGS. 12 and 13, in place of a seat like the ones defined by the banks 3 and ledges 5 there is provided a unit which includes a continuous belt conveyor 72 (or a multiple belts conveyor) driven between two rolls 74 and 76, the latter being likely the driving roll controlled by a geared motor 78. The active upper branch of the conveyor 72 moves according to arrow f72 with an intermittent movement determined in the manner indicated afterwards.

By 80 there is indicated a pile of components of considerable thickness which have to be individually fed in the considered position where the equipment is placed. The pile 80 feeds the pieces as they come to the lower position laid on the active upper branch of the continuous conveyor. By 801 there is indicated the piece in pick up position, by 802 there are indicated one or two pieces in an intermediate transferring position, and by 803 there is indicated the piece in a position of pick up by means of the sucker which lowers down in position 7A and then performs the trajectory T7 from the hold position 7A to the release position 7B on the conveyor 12, 14, 15. The various pieces on the active branch of the conveyor 72 may be more or less drawn together or partially overlapped, the piece in position 803 being able to be withdrawn from below a piece in position 802, for the effect of the pick up by sucker 7 which moves from the hold position 7A along the trajectory T7 according to arrow f7. The pile 80 may be of whatever height, even a very elevated one and may be included between suitable lateral and front banks, or simply limited to two angle irons 82 along the angles closest to position 803. Along the drawing edge there is provided a regulator of the passage way slot of pieces 801, including a support structure 84 and an adjustable bank 86 whose lower edge is adjusted remote from the active branch of the conveyor 72 as a function of the thickness of the piece fed by the pile 80, like the thickness of the signature to be fed. In this way the movement of the conveyor 72 according to arrow f72 causes the drawing of the lower piece 801 only, while the upper pieces of the pile are retained. By 88 there are indicated two banks which flank the pieces transfer zone from pile 80 to the pick up position 803. These banks are fixed or, at least, in particular, it is fixed the bank which determines the sliding lateral ledge of the sheets as they reach the position 803. Thus, the suckers 7, by picking up the sheet in the position 7A, carry said sheet—by transferring themselves in the position 7B—with the edge corresponding to said lateral edge always in the same position, whatever the sheet format may be and in particular in the position of lifting up again the element 14 of the conveyor. The conveyor 72 may be adjustable in position, unless it is provided with a width equal to the maximum one necessary, especially if it is made up of a plurality of belts. In the case of very large formats it is possible to shift a bank, to add a bearing plane and translate the belt 72 to the lateral stroke end, provided that it results substantially centered. In order to guide the individually fed pieces and to define the hold position 803, two ledges 90 are provided, against which the piece must rest in the position 803, these ledges 90 being also adjustable transversally to the advancement direction f72.

By 92 there is indicated a contact surface carried by the machine structure or by the equipment in object, and which may also be, simply, an earthed metal surface of the machine unit. A single surface 92 or two surfaces opposite to each other in respect of the fed-pieces holding position 803 may be provided. However a contact surface 92 remains at least partially covered by the piece which is in the position 803 and is discovered when the piece is picked up by the suckers in position 7B. A fly spring 94 cooperates with one or each surface 92, and it exerts a slight pressure against the surface 92 respectively on the piece in position 803. The fly spring 94 is carried electrically insulated by a support 96 which is adjustable in position on one of the banks 88 or in other suitable way parallely to the advancement direction f72 of the pieces which reach the position 803. The switch, practically made up by the spring 94 and surface 92, is controlled by the presence or lack of a piece in position 803. This switch controls the operation of the geared motor 78 or the intermittent movement of the conveyor 72. The purpose of this switch is to determine the operation of the conveyor 72 as soon as the suckers in the position 7A have picked up the piece at position 803 to lay it onto the conveyor 12, 14, 15; at that moment, by establishing the contact between the spring 94 and the surface 92, the conveyor 72 is put into operation and it transfers a piece from position 802 to position 803 and withdraws the piece 801 from beneath the pile 80 to bring it into a position 802. Obviously the movement will be sufficiently rapid in accordance with the machine timing, and thus, inertia may occur both in the displacement of the pieces from position 802 to position 803, and in the displacement of the mechanic members like those 78, 76, 74, 72. The adjustment of the fly spring 94 position has the purpose to find the most suitable point to obtain the timely cut off of the conveyor 72 driving circuit, in such a way that a piece which gets to the position 803 will arrive therein bearing against the ledges 90 owing to the effect of the possible remainder of movement due to inertia of the whole moving members, without appreciable shocks and relevant irregularities of the stopping of the piece in position 803, and with regularity of the other connected movements too. The position adjustment of the spring 94 is also such to ensure a timely starting of the movement with the drawing of the piece in position 803 by the suckers. On the other hand, the presence in position 802 of a piece ready for a quick and timely transfer to position 803, ensures the possibility to obtain the transfer cycle in the times imposed by the machine without excessive accelerations and decelerations.

Suitable arrangements may be provided to consent the possible backwards moving for a short lenght of the piece into position 803 at the moment of the pick up by suckers 7 and soon before the lifting up. For this purpose, limited spacings can be provided between the positions 803 and 802 or a partial overlap of the leading edge of the piece at the position 802 on the final edge of the piece in position 803.

What is claimed is:

1. A machine for the formation of booklets with intercalated multiple sheets, comprising:

means for forming a plurality of fixed seats each for a pile of sheets;

a main conveyor having a stationary longitudinal plane, a plurality of mobile longitudinal bars each with pegs forming a plurality of transfer seats means for a reciprocating displacement of said bars in a vertical direction from a position with said bars and pegs below said plane to a position with said bars and pegs above said plane and in a horizontal direction with respect to said stationary plane for advancing sheets in an advancement direction;

holding means for transferring individual sheets of each pile to said main conveyor;

a secondary conveyor operatively associated with at least one of said fixed seats for a pile of sheets having a greater thickness than sheets of other piles, operable to withdraw a lowermost sheet of the pile in said at least one fixed seat and to bring it to a holding position for said holding means, said secondary conveyor operable to move said sheets in a direction substantially transverse to the advancement direction from the pile at said at least one fixed seat to said holding position;

drive means for driving said secondary conveyor operatively coupled to said holding means and operating in synchronism with the transfer of a sheet from said holding position to said main conveyor, which successively receives the sheets of the booklet, a frame carrying said main conveyor, said means forming a plurality of fixed seats and said secondary conveyor, a support structure above said secondary conveyor for restraining all but a lowermost sheet of the pile in said at least one fixed seat from movement by said secondary conveyor in the direction transverse to said advancement direction; and an adjustable bank movably mounted on said support structure for adjusting a distance between said secondary conveyor and said support structure to correspond to a thickness of sheets in the pile at said at least one fixed seat;

said holding means comprising a suction holder movable from said holding to said main conveyor;

said means for reciprocating displacement of said bars comprising a slide bar to which said bars with connected pegs are slidably mounted, first crank means connected to said slide bar for lifting and lowering said slide bar, an oscillating bar pivotally connected at one end to said bars and an opposite end to said frame, and second crank means connected to said oscillating bar at an intermediate location thereof for moving said bars and pegs in said advancement direction.

2. A machine according to claim 1, wherein said driving means are adjustable in position in the direction of transferring a sheet from the pile to said hold position, to ensure a correct reaching of a ledge defining said holding position.

3. A machine according to claim 1, further including a lateral support for sheets of format double that of usual sheets, and wherein the conveyor for feeding said sheets is movable towards said support.

4. A machine according to claim 1, wherein said driving means includes a switch having two terminals, at least one of which is elastic, and which are in positions opposite to a sheet brought to said holding position and which make contact upon the drawing of the sheet from said holding position and which break contact at the arrival of another sheet to said position.

5. A machine according to claim 1, characterized by the fact that said driving means includes a microswitch actuated by one of a thickness and a front edge of a sheet brought to said holding position.

6. A machine for the formation of booklets with intercalated multiple sheets, comprising:

means forming a plurality of fixed seats each for a pile of sheets;

a main conveyor having a stationary longitudinal plane, a plurality of mobile longitudinal bars each with pegs forming a plurality of transfer seats, means for a reciprocating displacement of said bars in a vertical direction from a position with said bars and pegs below said plane to a position with said bars and pegs above said plane and in a horizontal direction with respect to said stationary plane for advancing sheets in an advancement direction;

holding means for transferring individual sheets of each pile to said main conveyor;

a secondary conveyor operatively associated with at least one of said fixed seats for a pile of sheets having greater thickness than sheets of other piles, operable to withdraw a lowermost sheet of the pile in said at least one fixed seat and to bring it to a holding position for said holding means;

driving means for driving said secondary conveyor operatively coupled to said holding means and operating in synchronism with the transfer of a sheet from said holding position to said main conveyor, which successively receives the sheets of the booklet;

said means for a reciprocating displacement of said bars comprising means for effecting a modifiable articulation to obtain a longitudinal stroke of said bars, which includes a crank with a slot along which at least three adjustable seats are formed, a first pivot sliding in said slot, a connecting rod articulated to said first pivot, a lever for driving said bars in the longitudinal stroke, said lever including a slot with at least three grooves therein for a second pivot articulating said connecting rod to said lever; and said first pivot comprising axial grip means for blocking said first pivot at one of said three adjustable seats, for establishing a longitudinal stroke corresponding to the maximum format of each sheet, a medium format of each sheet equal to one-half the maximum format and a further format which is one-half the medium format, each longitudinal stroke taking place in the advancement direction.

* * * * *